US010794669B1

(12) United States Patent
Gersznowicz

(10) Patent No.: US 10,794,669 B1
(45) Date of Patent: Oct. 6, 2020

(54) HANDHELD PERSONAL SAFETY DEVICE

(71) Applicant: Alex Gersznowicz, San Francisco, CA (US)

(72) Inventor: Alex Gersznowicz, San Francisco, CA (US)

( * ) Notice: Subject to any disclaimer, the term of this patent is extended or adjusted under 35 U.S.C. 154(b) by 0 days.

(21) Appl. No.: 16/836,238

(22) Filed: Mar. 31, 2020

(51) Int. Cl.
*F41H 13/00* (2006.01)
*F21V 21/40* (2006.01)
*F21V 33/00* (2006.01)

(52) U.S. Cl.
CPC ..... *F41H 13/0087* (2013.01); *F21V 21/406* (2013.01); *F21V 33/0084* (2013.01)

(58) Field of Classification Search
CPC ..... F21H 13/0087; F41B 15/08; F21L 4/027; F21L 4/00; F21V 21/406; F21V 33/0052; F21V 33/0084; F21V 33/008; F21W 2131/30; F41H 13/0087
See application file for complete search history.

(56) References Cited

U.S. PATENT DOCUMENTS 5,428,514 A 6/1995 Fink
5,509,708 A 4/1996 Nathan
5,549,220 A 8/1996 Whalen
5,556,003 A 9/1996 Johnson et al.
5,875,945 A 3/1999 Roach
5,893,483 A 4/1999 Duran
7,771,076 B1 * 8/2010 Mattheis ..... F21L 4/027 362/184
8,096,674 B2 * 1/2012 Matthews ..... F21V 23/0421 362/206
8,201,964 B2 * 6/2012 Mattheis ..... F21L 4/027 119/796
8,363,376 B2 1/2013 Abatemarco
8,424,350 B2 * 4/2013 Bernatchez ..... A44B 15/00 70/456 R
9,488,349 B2 * 11/2016 Farina ..... F21L 4/00
9,713,216 B2 7/2017 Urry et al.
10,054,305 B1 8/2018 Slepack
10,347,144 B2 7/2019 Subiakto
2005/0059533 A1 3/2005 Hobbs
2007/0142115 A1 * 6/2007 Tal ..... F41B 15/08 463/47.2
2007/0238532 A1 10/2007 Stethem
2007/0274700 A1 11/2007 Dalby et al.
(Continued)

FOREIGN PATENT DOCUMENTS

CN 202901848 U 4/2013
CN 203182081 U 9/2013
(Continued)

OTHER PUBLICATIONS

Brass Knuckles Company; Tasers, rechargable stun batons and flashlights; 6 pages; retrived from the internet (https://www.brassknucklescompany.com/stun-guns) on Apr. 8, 2020.

*Primary Examiner* — Peggy A Neils
(74) *Attorney, Agent, or Firm* — Shay Glenn LLP

(57) ABSTRACT

Described herein is a wearable personal safety device. The device may include one or more finger holders for receiving a user's fingers and may be held inside a person's hand. The device may include a dazzling light source and a camera and may be configured to shine a dazzling light towards a would-be attacker and to take an image with the camera.

20 Claims, 5 Drawing Sheets

(56) References Cited

U.S. PATENT DOCUMENTS

| | | | |
|---|---|---|---|
| 2009/0097235 | A1 | 4/2009 | Chambers |
| 2010/0237098 | A1 | 9/2010 | Kaufman |
| 2011/0210146 | A1 | 9/2011 | Dapper |
| 2012/0327644 | A1 | 12/2012 | Woods |
| 2015/0312399 | A1 | 10/2015 | Teig |
| 2016/0334194 | A1 | 11/2016 | Komperda |
| 2019/0212102 | A1 | 7/2019 | Shannon |
| 2019/0234706 | A1 | 8/2019 | Deveau |

FOREIGN PATENT DOCUMENTS

| | | | |
|---|---|---|---|
| CN | 204305095 | U | 4/2015 |
| CN | 204647885 | U | 9/2015 |
| CN | 207039741 | U | 2/2018 |
| CN | 108718202 | A | 10/2018 |
| CN | 208011360 | U | 10/2018 |
| CN | 208624703 | U | 3/2019 |
| CN | 209214439 | U | 8/2019 |
| DE | 102011012653 | A1 | 8/2012 |
| WO | WO2008/113846 | A1 | 9/2008 |
| WO | WO2010/015000 | A1 | 2/2010 |
| WO | WO2014/131050 | A1 | 8/2014 |

* cited by examiner

HANDHELD PERSONAL SAFETY DEVICE

CROSS REFERENCE TO RELATED APPLICATIONS

None.

INCORPORATION BY REFERENCE

All publications and patent applications mentioned in this specification are herein incorporated by reference in their entirety to the same extent as if each individual publication or patent application was specifically and individually indicated to be incorporated by reference.

FIELD

The present disclosure relates to a wearable or handheld personal safety device, such as for delivering a dazzling light for disorienting a subject, such as a potential attacker, and taking an image of the subject.

BACKGROUND

Muggings and assaults are a dangerous and traumatizing experience. People involved in health and fitness activities such as running or walking outdoors and people walking home from work run a risk of being mugged or assaulted. People at higher risk of being mugged or assaulted due to their work include grocery store clerks, gas station attendants, security guards, and law enforcement officials. Personal safety remains a great concern for a very large number of people.

While a device may help an individual deter an attack from a potential attacker in a dangerous situation, such as a person trying to grab or rob the individual, individuals do not use a device during most crimes. Assaults on individuals remain very common. An individual might not use a device during an attack, because the device is not available to the individual because such devices are too large, too cumbersome, buried in a purse or backpack, or otherwise difficult to carry and use. Even if an individual has a device with them during a potential attack, an individual may drop it, particularly when startled by an attacker. Accordingly, there is a need for personal safety devices that are easy to carry, easy to use, and effective.

Described herein are personal safety devices that may address some of these or other disadvantages and provide an individual with a safety device for increasing personal safety in potentially dangerous situations.

SUMMARY OF THE DISCLOSURE

The present invention relates to apparatuses (devices and systems) for personal safety and methods of using the apparatuses.

One aspect of the disclosure provides a wearable device including an elongate housing with a first end and a second end and a length between. In some embodiments, the housing is generally cylindrically shaped and grippable by a user's hand. Some embodiments include a plurality of finger holders on an outside surface of the elongate housing. In some embodiments, the finger holders each have an opening perpendicular to and extending away from a plane through the longitudinal axis of the housing, the finger holders configured to receive a user's fingers. Some embodiments include a light source in the elongate housing, the light source configured to direct a dazzling light in a direction generally opposite to the plurality of finger holders. Some embodiments include a camera in the elongate housing, the camera pointing in a direction generally opposite to the plurality of finger holders and in generally the same direction as the light source. Some embodiments include an on/off controller on the first end, the on/off controller configured to activate with a single user action both the light source and the camera to shine a dazzling light and capture an image at about the same time.

Some embodiments of the wearable device further include a camera hole in the elongate housing, wherein the camera hole is on the opposite side of the housing from the plurality of finger holders. In some embodiments, the camera is configured to obtain an image through the camera hole.

In some embodiments, the light source and a light covering extend along a long side of the housing between the first end and the second end. In some embodiments, the light source extends at least halfway along a long side of the housing between the first end and the second end. In some embodiments, the light source includes a plurality of LED lights. In some embodiments, the light source includes an elongate bank of co-linear LED lights.

In some embodiments, the camera is co-linear with the LED lights. In some embodiments, the device is configured to deliver at least 100 lumens of light. In some embodiments, the camera and the light source point in the same general direction.

In some embodiments, the housing includes a concave surface extending laterally around the housing. In some embodiments, the device is less than about 6 inches in the longest direction and less than about 3 inches in a cross-sectional diameter.

In some embodiments, the wearable device includes three finger holders. In some embodiments, the finger holders are substantially coplanar. In some embodiments, the on/off controller is configured to be controlled by a user's thumb when the wearable device is in place on a user's hand.

Another aspect of the disclosure provides method of using a wearable device including placing a plurality of a user's fingers into openings of finger holders of a wearable personal safety device. Some embodiments include wherein the wearable device includes an elongate housing having a concave surface extending laterally around the housing, a camera, and a dazzling light source, and the finger holders are connected to a long side of the elongate housing. Some embodiments include the step of activating the camera and the dazzling light source. Some embodiments include the step of taking a picture with the camera while the light source shines.

In some embodiments, the light source includes a plurality of LED lights co-linear with the camera, and taking a picture includes the step of directing the dazzling light and camera in a direction generally opposite to the plurality of finger holders.

Some methods further include the steps of resting the finger holders of the handheld device on the distal palmar surface of the hand.

Some methods include the step of raising the hand in front of the body and opening the palm of the hand away from the body. In some methods, the step of activating the camera and the dazzling light source includes delivering at least 300 lumens of dazzling light.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

Described herein are wearable apparatuses (devices and systems) for personal safety and methods of using the wearable apparatuses. The devices may be especially useful for an individual to carry for use on a potentially dangerous person to stop the person. The wearable devices may produce sufficient optical radiation to cause optical incapacitation of a potential attacker (e.g., disorienting or dazzling a person or animal with an extremely bright light) and an image sensor for taking an image (picture or video) of the person or animal at the same time. Optical radiation for optical incapacitation may include light that is sufficiently bright to disorient or temporarily blind a person or animal, although the optical radiation may not cause permanent blindness. Optical radiation for optical incapacitation is very strong and may cause nausea, dizziness, headache, flash blindness, eye pain, and/or vomiting when viewed by a person (e.g., a potentially dangerous person). One difference between a regular flash light and a light from a wearable safety device for optical incapacitation is the brightness the light from the wearable safety device (measured in lumen). A device as described herein may contain sufficient battery power and appropriate light sources to dazzle and disorient a person, such as a potential attacker and be able to repeat the process on the same or another attacker (e.g., one times, five times, ten times). The device may be handheld or wearable on a person's hand In addition to being a great self-defense tool, the devices may be safe to travel with or carry even in places where other personal safety tools (e.g., mace, stun devices, guns) may be illegal to carry (e.g., on an airplane). The wearable device 2 may be sized to readily fit in a user's hand, comfortable enough to wear, easy to turn on, dazzlingly bright, and reliable. A light that a person does not carry with them because it is heavy or uncomfortable to hold or that has been dropped during a dangerous situation is useless for self-defense and so the device described herein may be ergonomic and comfortable to carry.

Figure 1:
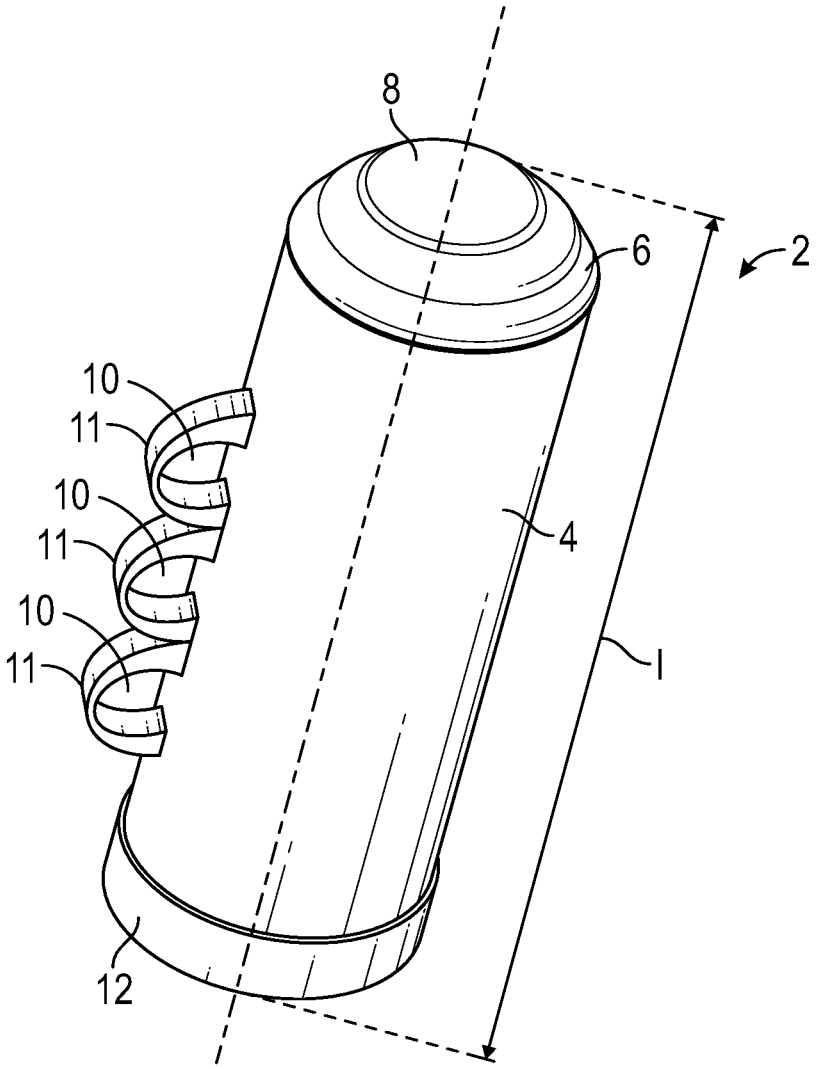
FIG. 1 is a sketch of a side perspective view of a wearable or personal safety device.

FIG. 1 is a sketch of a side perspective view of a handheld or wearable device 2. FIG. 1 shows the handheld or wearable device 2 with an elongate housing 4 and a first end 6 and a second end 14 and a length between, and a plurality of openings 10 (also called finger holes) on the housing.

The wearable device 2 may have one opening 10 or a may have a plurality of openings (e.g., two openings, three openings, four, or five openings) or finger holes for receiving a user's fingers. An opening 10 may be defined by a finger holder 11, such as a partial ring or arch extending from housing 4. The finger holder 11 is configured to fit around a user's finger. In a particular example, the wearable device 2 includes three finger holders and three openings for receiving three fingers. FIG. 1 shows a plurality of finger holder 11 on an outside surface of the elongate housing 4. The finger holders 11 have openings perpendicular to and extending away from a plane through the longitudinal axis of the housing (see the plane in FIG. 1). The finger holder(s) 11 are configured to receive a user's finger(s) therethrough (see also FIG. 4 and FIG. 5).

Figure 2:
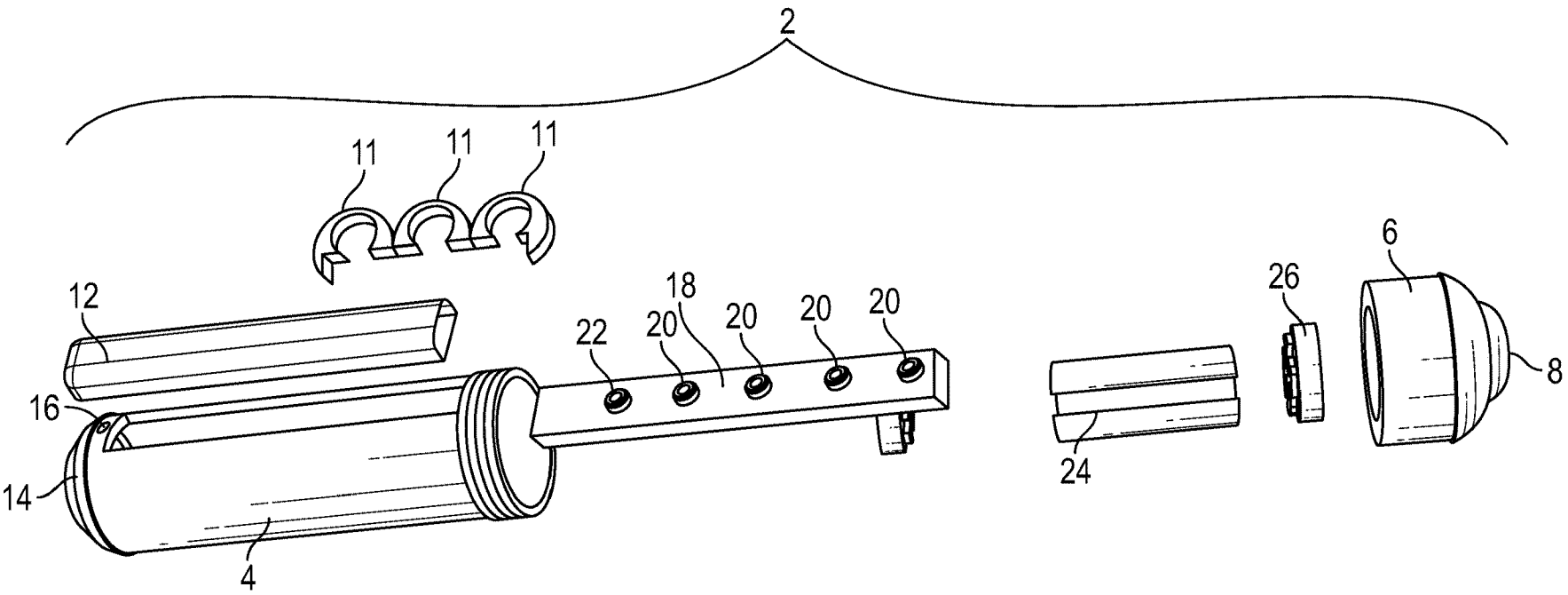
FIG. 2 is an exploded view of the wearable device shown in FIG. 1.
Figure 3:
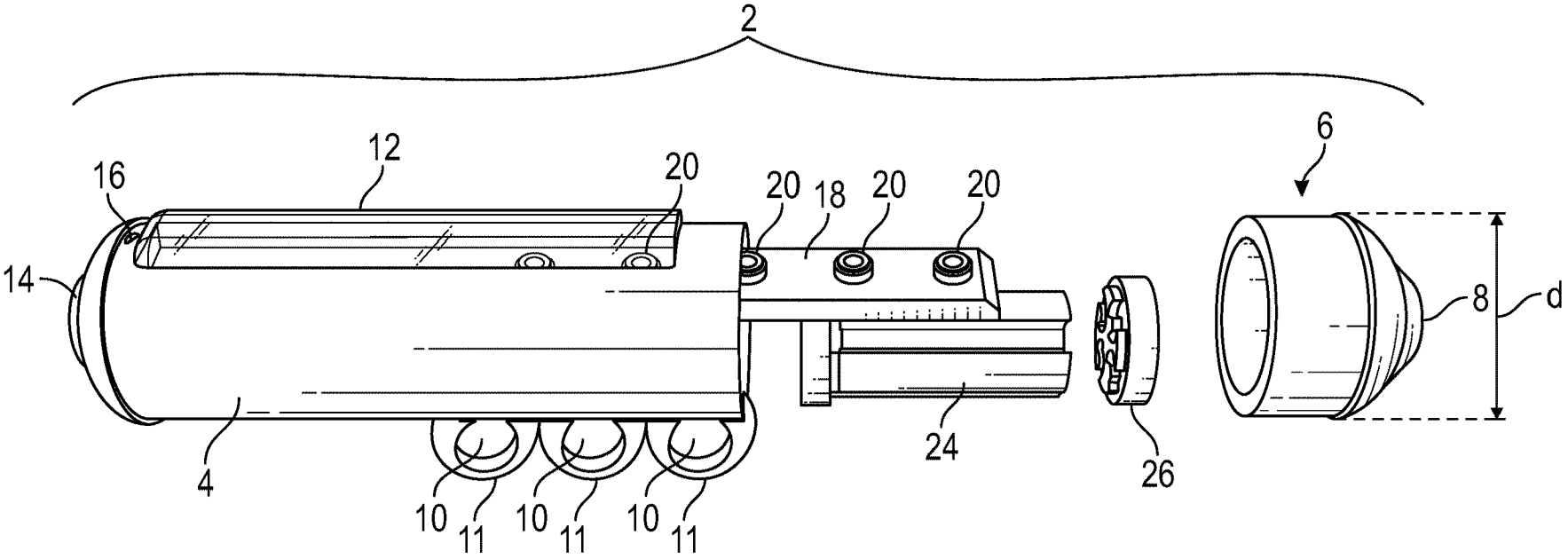
FIG. 3 is another exploded view of the wearable device shown in FIG. 1.

FIG. 2 and FIG. 3 show exploded views of the wearable device 2 shown in FIG. 1. FIG. 2 and FIG. 3 show the wearable device 2 with the light cover 12. The light cover 12 is on the housing 4 and, as explained in more detail below, generally on the opposite side of the housing 4 from the finger holder 11. FIG. 2 also shows the wearable device 2 also includes a light source 20, a camera 22, a battery case 24 for holding a battery (best seen in FIG. 3), and a battery connector 26. FIG. 2 also shows a camera hole 16 and a camera 22 inside the housing 4. The camera hole 16 is generally on the opposite side of the housing 4 from the finger holder 11. FIG. 3 also shows the on/off controller 8.

Figure 4:
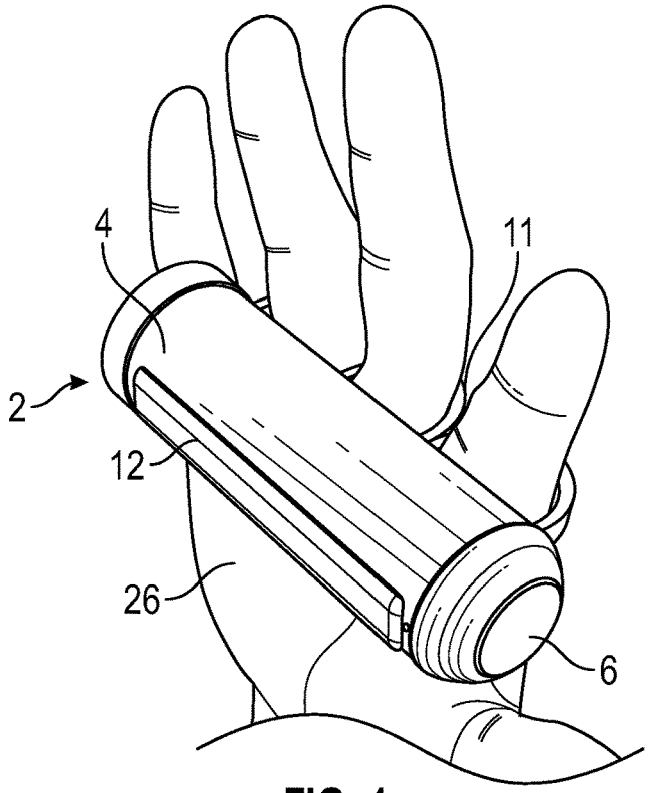
FIG. 4 is a sketch of the wearable device described herein as worn by a user during device use.
Figure 5:
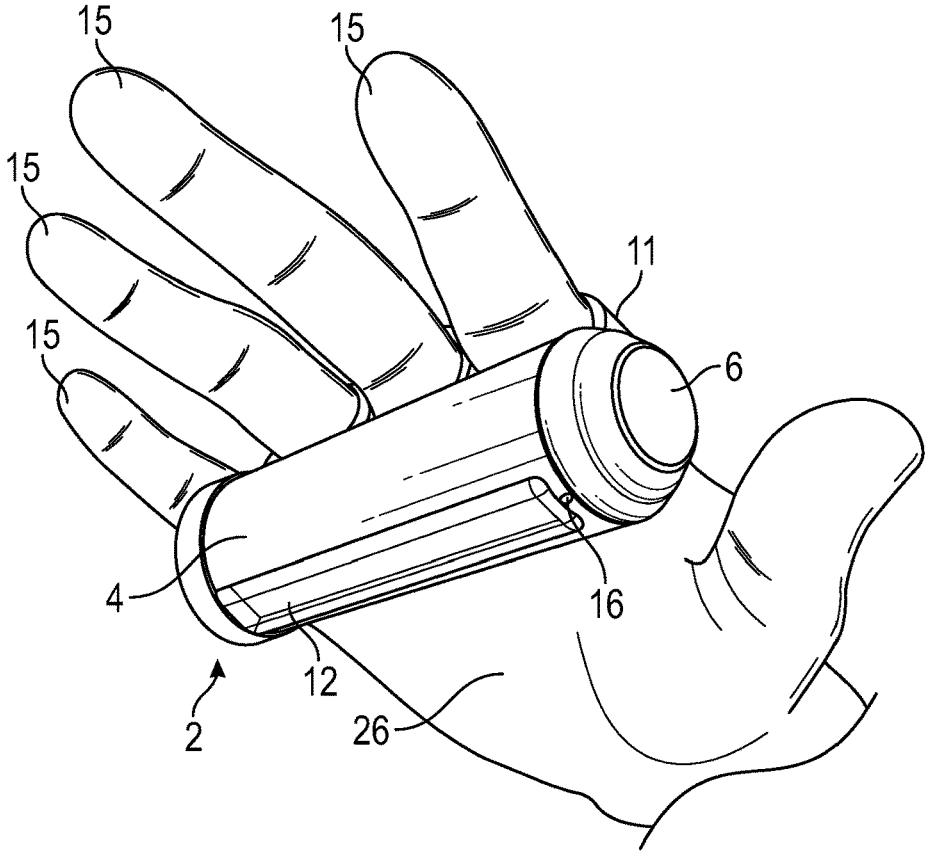
FIG. 5 is another sketch of the wearable device described herein as worn by a user during device use.

FIG. 4 and FIG. 5 show the handheld or wearable device 2 as held on a user's hand during device use. As indicated above, the finger holder 11 are configured to receive a user's fingers therethrough. A plurality of finger holder 11 on the device 2 may be coplanar or substantially coplanar and one or more finger holder 11 may be offset slightly from another finger holder 11. For example, a ring for the fifth digit (also called the little finger or pinkie) may be slightly offset to accommodate natural hand anatomy. The finger holder 11 with the "top" part of the finger holder 11 (e.g., the part of the rings furthest away from the housing 4) receiving the back or dorsal side of the hand, and the "bottom" part of the finger holder 11 (e.g., the part of the rings closest to the housing 4) and on the front (palmar) side of the hand. Thus, the wearable device 2 can be considered to have a dorsal part (the parts of the finger holder 11 and openings 10 configured to be held on the dorsal side of the hand during wear) and a palmar part (the part of the rings 10 and openings 10 configured to be held on the palmar side during device wear as well with the housing 4).

The dorsal part of the finger holder 11 extends in a dorsal direction (e.g., away from the back of the hand) and the light source 20 shines or is configured to shine in a palmar direction (e.g., from the palm of the user's hand 28 away from the palm). The light source 20 may be on an opposite side of the housing 4 from the finger holder 11. For example, the light source 20 may be more or less directly opposite from the finger holder 11 (e.g., about 180° around an outside of the housing 4) or may be somewhat offset from that (e.g., within about 90°, within about 45°, within about 30°, or within about 15° on either side of the 180° position). FIG. 5 also shows the camera hole 16. The camera 22 (though the camera hole 16) points away from the palm, and takes an image in a direction looking away from the palm of the user's hand 28. The camera hole 16 and camera 22 may be positioned for capturing an image of an attacker when the palm is opened and in front of the individual. The camera hole 16 may be on an opposite side of the housing 4 from the finger holder 11. For example, the camera hole 16 may be more or less directly opposite from the finger holder 11 (e.g., about 180° around an outside of the housing 4) or may be offset from that (e.g., within about 90°, within about 45°, within about 30°, or within about 15° on either side of the 180° position). FIG. 5 (and see also FIG. 3) shows the camera hole 16 co-linear with the light cover 12 and FIG. 2 also shows the internal housing 18 holds a plurality of lights, as well as the camera 22. FIG. 2 also shows the plurality of lights and the camera 22 are co-linear, although this is not necessary. This configuration may be easy to assemble from a manufacturing point of view, though other configurations are also possible (e.g., the camera 22 may be separate from the internal housing 18). The light cover 12 (and associated internal housing 18 and light source 20) may extend most of the way along the elongate housing 4 or partway along the elongate housing 4 (e.g., at least 25% of the length, at least 50% of the length, at least 75% of the length, at least 90% of the length). Further extension along the elongate housing in some examples may lead to a more extensive (larger cone) of light though other factors are also considered, such as the direction a light points from the internal housing 18.

The device 2 can be grippable by a user's hand. For example, the device 2 may be shaped and sized for gripping. The device 2 may be generally cylindrically shaped, have a length (1) greater than a cross-section (e.g., a diameter (d) or other cross-sectional distance), and have a generally curved outside surface (e.g., about the circumference or perimeter, depending on the device details). The generally cylindrically shaped device 2 may have a more or less regular cylinder shape or an irregular cylindrical shape (e.g., a barrel shape, a cylindroid, an elliptical cylinder). The device 2 may be at least 2 inches in a longest direction, at least 3 inches in a longest direction, at least 4 inches in a longest direction, at least 5 inches in a longest direction, at least 6 inches in a longest direction, or less than 10 inches, less than 8 inches, less than 7 inches, less than 6 inches, less than 5 inches, less than 5 inches, less than 3 inches in a longest direction or anything between these dimensions (e.g., at least 4 inches and less than 7 inches. The device 2 may be at least 0.5 inches across, at least 1.0 inch across, at least 1.5 inches across, at least 2.0 inches across, at least 2.5 inches across, at least 3 inches across (either in diameter (d) if the device has a circular cross section or in a widest dimension for the cross section is not circular) and/or less than 5 inches, less than 4 inches, less than 3 inches, less than 2 inches, or anything between any of these dimensions (e.g., at least 0.5 inches and less than 4 inches. Size may be chosen so that the light source produces sufficient lumens for dazzling while having sufficient but not too much weight. Size may also be chosen based on hand size (e.g., a measurement around a circumference of hand just above the knuckles) and may be configured to fit a circumferential hand size, such as from about 6" to about 12" (or any value between these). In some examples, the device is at least 4 inches long and not more than 6.5 inches long and at least 1.5 inches in diameter or cross-section and not more than 3.0 inches in diameter or cross-section.

The generally cylindrically shaped device 2 may have one or more protrusions (e.g., ring(s) 10, bump(s), flared region (s)), indentations (e.g., finger grip region(s), notch(es), scored region(s)), or holes and including light housings and camera holes. The size and shape of the device 2 and any protrusions or indentations may be chosen, for example, for comfort, durability, and/or grip.

While the device 2 may be grippable and may be gripped, the device 2 may not need to be gripped during use. The device 2 may be configured to be passively carried or held by hanging by or being suspended from the finger holder 11 on a user's hand 28, without requiring the user to grip the device 2 to carry the device (although they could). Passively carrying the device may be more comfortable for a user carrying a device for an extended period (e.g., while running or walking), and this comfort may allow more frequent device use (carrying). Additionally, during device use (e.g., light source 20 and/or camera 22 activation and use), the device 2 may hang from a user's fingers 15 though the device 2 may also in part rest on the palmar part of the user's hand, such as on the fleshy palmar part of the palm nearest the fingers.

In particular, for use, the device may be configured so that the user can extend their hand in a palm open position towards the attacker or other object of concern in a defensive or "stop" position. The light source 20 and camera 22 are located on the palmar part of the device 2 so that when the palm is open or the fingers extended, the user's fingers are not in front of the light source 20 and camera 22. The finger holder 11 around the user's fingers can ensure that device 2 is not inadvertently dropped (especially during a tense or dangerous situation) even without any gripping of the device 2 by the user's hand. Even while scrambling away or running from a potential attacker, the device 2 may very well stay on the user's hand and remain available as a wearable device to the user that can be used repeatedly. Thus, the wearable device 2 includes the light 20, configured to direct a dazzling light in a direction generally opposite to the plurality of finger holder 11 and/or a camera 22 configured to direct a dazzling light in a direction generally opposite to the plurality of finger holder 11 and to do so when the user's palm is open and/or the fingers extended.

In some variations, a finger holder may have a hard outer surface (the part furthest away from the palm). The hard outer surface may be configured to reinforce the back of a person's hand for deterring (e.g., hitting or punching) an attacker. The finger holder may be similar to a "brass knuckles" defense item. The outer surface of the finger holder may partially "wrap" around each finger (e.g., in a crescent shape around one, two, three, or four fingers) or may have a flat or curved (e.g., convex) surface that goes over one or more fingers (and does not partially wrap around the finger). The outer surface may have protrusions that may increase its effectiveness at deterring (e.g., hitting or punching) an attacker. The finger holder may be made of a strong hard substance, such as aluminum, copper, sterling silver, another metal, plastic or rubber. In some examples, a safety device may have a sufficient weight to aid in its use as a deterrent (e.g., for hitting or punching) an attacker. A safety device may weigh at least 100 grams, at least 200 grams, at least 300 grams, at least 400 grams or at least 500 grams or not more than 100 grams, not more than 200 grams, not more than 300 grams, not more than 400 grams, or not more than 500 grams or may weigh any amount between these values (e.g., at least 150 grams and not more than 500 grams. In some variations, the finger holder 11 may be made from fabric, such as woven or stretchy fabric, metal and/or plastic and may be attached to the housing 4 or the finger holder 11 may be integral to the housing 4. The finger holder 11 may be cut, extruded, molded, printed, (e.g., 3D printing), woven, or sewn and may be attached to the housing 4 using epoxy or glue.

The finger holder 11 may have an interior or exterior cross-section shape that is generally a circular cross-sectional shape, an ovoid cross-sectional shape, a rounded square cross-sectional shape, a rounded rectangular cross-sectional shape, a tear-drop cross-sectional shape or a variation of these. Where more than one finger holder 11 is present on a device 2, each ring may have interior (inside) and exterior (outside) cross-sectional shapes that are the same or different from one another. The finger holder 11 can be a closed ring or an open ring. A closed ring can have a continuous surface (around the opening) and no gap, while an open ring can have a discontinuous surface (around the opening) with or without a space between two parts on the ring. For the purposes herein, a gap may be considered a break in continuity so that a ring that has a discontinuous surface may be considered to have a gap, even if the two opposing parts of the ring are very close (touching one another). A gap in the finger holder 11 may extend partway around the finger holder 11. For example, the gap in the finger holder 11 may extend less than 180° around the ring, less than 150°, less than 125°, less than 90°, less than 45°, or less than 20°. In some examples, the finger holder 11 may have a changeable gap to, for example, aid in putting on and/or taking off the wearable safety device 2. Thus, some embodiments include the step of increasing an existing gap size (e.g., to aid in putting the safety device over the user's fingers) and/or the step of decreasing an existing gap size (e.g., to aid in holding the safety device on a user's hand). A size of a changeable gap may be changed, for example, by an elastomeric ring and stretching the elastomeric ring, increasing an existing gap size, or releasing an elastomeric ring, decreasing an existing gap size. The finger holder 11 may be adjustable, and may have an adjustable gap. For example, the finger holder 11 may have a first end and a second end that can be pushed towards or past one another (e.g., to better fit around a user's fingers) and the first end and second end are configured to stay put wherever they are pushed. In some embodiments, a finger holder 11 may include two (or more than two) parts or regions connected by a mechanical element, such as a hinge and pin, so that the finger holder 11 can be opened (e.g., for finger entry and finger removal) and closed.

The light source 20 may be configured to dazzle the human eye, leading to temporary disorientation. The light source 20 may dazzle and so a potential attacker may have a time of only seeing bright light, followed by a time of only seeing black while the would-be attacker's eyes adjust. This may give the person with the device time to escape or get help. This process can be repeated and may be a significant deterrent to a would-be attacker. The light source 20 may be an LED light (light emitting diode), a flashtube, or an electric arc lamp, including associated components such as resistors and heat sinks. A light source 20 may be single light or a plurality of lights, such as a bank of two, three, four, five, more than five, or more than ten LED lights. A plurality of lights may be in a row (e.g., linear) or may be staggered from one another. The light source 20 may be configured to deliver at least at least 30 lumens, at least 100 lumens, at least 200 lumens, at least 250 lumens, at least 300 lumens, at least 400 lumens, at least 500 lumens, at least 1,000 lumens, at least 1,500 lumens, at least 5,000 lumens, at least 10,000 lumens, or at least 500,000 lumens. At least 1 million lumens, or at least 10,000,000 lumens and/or less than 10,000,000 lumens, less than 1 million lumens, less than 500,000 lumens, less than 20,000 lumens, less than 10,000 lumens, less than 5,000 lumens, or less than 1,500 lumens, less than 1,000 lumens, less than 500 lumens, less than 400 lumens, less than 300 lumens, less than 250 lumens, or anything between these values, such as at least 2000 lumens and less than 100,000 lumens. A higher lumen light, such as around 1,000 lumen, may be sufficient to disorient (temporarily blind) a would-be attacker wearing sunglasses. A light source my deliver optical radiation sufficient to temporarily disorient, impair vision, and/or incapacitate an aggressor from very close to the individual to further away (e.g., from less than 1 meter away to 100 meters away). Optical radiation delivered from the device may be sufficient to temporarily disorient, impair vision, and/or incapacitate an aggressor for between about 5 seconds to 3 minutes without causing permanent harm. The configuration (e.g., number of LEDs, number and power of batteries, device weight, device size) of the device may be chosen to deliver sufficient optical radiation for optical incapacitation for various uses. Thus, the device 2 may be used for personal safety in a number of different circumstances. In some variations, the light source 20 is configured to strobe and create a blinking light pattern with the light alternately shining and not shining. A strobe light may be especially useful for drawing the attention of other people. A light source may be configured to deliver polychromatic white light (range from 400 nm to 700 nm). In some variations, the light source may deliver red light (620-750 nm) and/or green light (495-570 nm). In some examples, the light source may be configured to deliver light around 532 nm (e.g., from 500 nm to 560 nm).

The wearable safety device may be configured to generate light with a beam angle sufficient to illuminate an attacker when the wearable safety device is held out in front of a user (e.g., from 15° to 120° or between these values such as from 30° to 45°). For example, a beam angle may be chosen in combination with other factors to accommodate both optical incapacitation efficiency and comfort/ergonomics. For example, a wearable safety device with a smaller beam angle that requires less battery power/weight may be easier to carry.

Some embodiments may include the step(s) of wearing a wearable device (e.g., over a user's fingers, over a metacarpal region of a user's fingers (the part closes to the base knuckles)), wearing a wearable device by suspending the device from the proximal part of the user's fingers (e.g., the metacarpal region).

A wearable personal safety device may also have a strike zone at the second end. The strike zone may be shaped and sized to be used as a weapon against an attacker, such as to strike an attacker. FIG. 2 and FIG. 3 show the wearable device 2 with second end 14. In use when the wearable device worn on a user's hand, the second end 14 is at the pinky or baby finger end of the hand. To use a strike zone, a user can hold the wearable device 2 (in a first) and strike an attacker with the strike zone. The strike zone may be flat or raised (knob shaped) and may have protrusions or indents such as small spikes, raised shards, or hard balls. The strike zone may be made from a hard material such as metal, hard plastic, or hard rubber. The housing 4, any protrusions, and/or any indentations may be made from an elastomeric material, a metal such as hard aluminum or an aluminum alloy, or a plastic and may be cut, extruded, molded, rolled, or printed, (e.g., 3D printed). Protrusions and/or indentations may be integral with the rest of the housing or may be attached (e.g., epoxied, glued, slip-fitted). The housing 4 may be covered or coated with a covering or coating such as rubber or plastic covering or coating. The housing 4, and the device 2, may be relatively inexpensive to make. A relatively inexpensive device 2, and especially one hanging inside a person's hand, may not attract attention and may provide an element of surprise against a potential attacker.

The battery compartment 24 and battery connector 26 may be configured to accept a battery which may be disposable or rechargeable, such as one or more than one (e.g., 1, 2, 3, or 4) AA battery, AAA battery AAA, 18650 lithium-ion battery, CR123A lithium battery, nickel metal hydride, nickel cadmium, or other lithium ion rechargeable battery. In some variations, the wearable device 2 includes a port for accepting a removable charger for recharging a rechargeable battery such as using a USB (micro USB) charger. The wearable device 2 may have a low battery indicator, such as a light that lights up when the battery is low. The wearable device 2 may have a battery with sufficient charge to deliver light when needed. A battery dedicated to the wearable device 2 for personal self-defense that only delivers power to a limited number of functions (e.g., camera and light) is very likely to have sufficient power to carry out its self-defense function without running out of battery. A battery may have sufficient power to light the light source 20 for at least 10 min, at least 20 min, at least 30 min, at least one hour, or at least two hours on full light and longer if the wearable device 2 has a strobe or low light option (such as for at least 5 hours, at least 10 hours or at least 15 hours). In some variations, the wearable device 2 includes a charger for recharging a rechargeable battery, such as using a USB (micro USB) charger.

The wearable device 2 may be configured (e.g., light source, light placement, battery power) to illuminate at least 100 feet, at least 200 feet, at least 300 feet, at least 400 feet, at least 500 feet, at least 600 feet, at least 700 feet, at least 800 feet, or at least 900 feet.

The on/off controller 8 may be on the first end 6 of the wearable or handheld wearable device 2. The on/off controller 8 may be located so that it may be easily turned on and off by touch or pressure from a user's thumb, such as when the device 2 is dangled or suspended on a user's hand as described elsewhere herein. The on/off controller 8 may have two functions/settings (on, off) or more than two functions. The on/off controller 8 may have one or a plurality of control elements for controlling device 2 function, and one element may be a "panic" button that simultaneously turns on the camera 22 and shines dazzling light from the light source 20. The on/off controller 8 may be configured to turn the light source 20 and camera 22 on at the same time and/or may turn them on separately. Some embodiments are configured so that the on/off controller 8 can be turned on or activated with a single user action on/off so that both the light source 20 and the camera 22 are activated. The light source 20 may shine a dazzling light and the camera 22 may capture an image at about the same time or may shine a dazzling light and capture an image sequentially. Turning the light source 20 and camera 22 on at the same time may allow the light source 20 to act as a flash for the camera 22 for illuminating an object of interest so that the camera 22 obtains a lighted image (e.g., a better quality image) of the object. The camera 22 may include an analog or digital camera and may capture still or streamed images and/or videos. The camera 22 may be configured to capture a single image or a plurality of images (e.g., a burst of 2-10 or a series of more than 10 images or video). In some examples, the camera 22 may include a photosensitive image sensor, such as a charge-coupled device (CCD) or a complementary metal oxide semiconductor (CMOS) designed for capturing the image and producing image data including electronic image information representing the image. The wearable device may include a memory card for storing images from the camera 22. The captured image(s), along with a message, may be transmitted to an external device (e.g., a smart phone, phone, tablet or computer associated with a security company, emergency services (911), police, an emergency contact, or the user). In some examples, the external device wearable device 2 may transmit unprocessed, raw imaging data to an external device and an external device may be configured to process the data. In some variations, the on/off controller 8 may have high light and low light settings for providing different intensities of light, such as a low light setting for illuminating a dark path and a high intensity light for dazzling an object of interest and taking an image (picture). In some variations, the on/off controller 8 may have a strobe function to strobe (intermittently flash) the light source 20.

Also described herein are methods of using the handheld or wearable device 2. The handheld or wearable device 2 may be configured with one or a plurality of finger holder(s) 11. The handheld or wearable device 2 may be configured with a dazzling light and may be configured to direct the dazzling light in a direction generally opposite to the one or plurality of finger holder(s) 11 on the handheld or wearable device 2. The handheld or wearable device 2 may also include a camera 22 configured to direct a dazzling light in a direction generally opposite to the one or plurality of finger holder(s) 11 and to do so when the user's palm is open and/or the fingers extended. Some methods may include the step of placing one or a plurality of a user's fingers into opening(s) 10 of finger holder(s) 11 of a wearable device 2. In some methods, the wearable device 2 includes an elongate housing 4 having a concave surface extending laterally around the housing, a camera 22, and a dazzling light source, and the finger holder(s) 11 are connected to a long side of the elongate housing 4. In some methods, the concave surface includes part or all of the light cover 12 and/or the camera hole 16. In some methods, the light source 20 includes a plurality of optical radiation sources co-linear with the camera 22. Some methods include taking an image with the camera, and in some methods, taking an image includes directing the dazzling light and camera in a direction generally opposite to the plurality of rings. Some methods include resting the finger holder(s) 11 and/or the housing 4 of the handheld wearable device 2 on the distal palmar surface of the hand.

Internal housing 18 of the wearable device 2 may include house a controller for controlling the operator of the components of the wearable device 2, such as the camera, battery, light source and/or other electronic components and/or connectors. The electronic components may include suitable components for detecting, processing, storing and/or transmitting image data or signals, such as electrical circuitry, an analog-to-digital (A/D) converter, and an electrical circuit for analog or digital short-range communication as well as electronics for providing the light source and other components of the device with a power supply. The wearable device 2 may include one or more antennas (cell antenna for transmitting and/or receiving; GPS antenna; Wi-Fi antenna). Communication between the wearable device 2 and an external device may be provided by a communications module, such as a wireless communications module (e.g., a cellular communication, Wi-Fi communication, Bluetooth®). The wearable device 2 may be configured to make a call or send a text. In some variations, the wearable device 2 is configured as a cell phone, and is able make and receive phone calls.

Figure 6A:
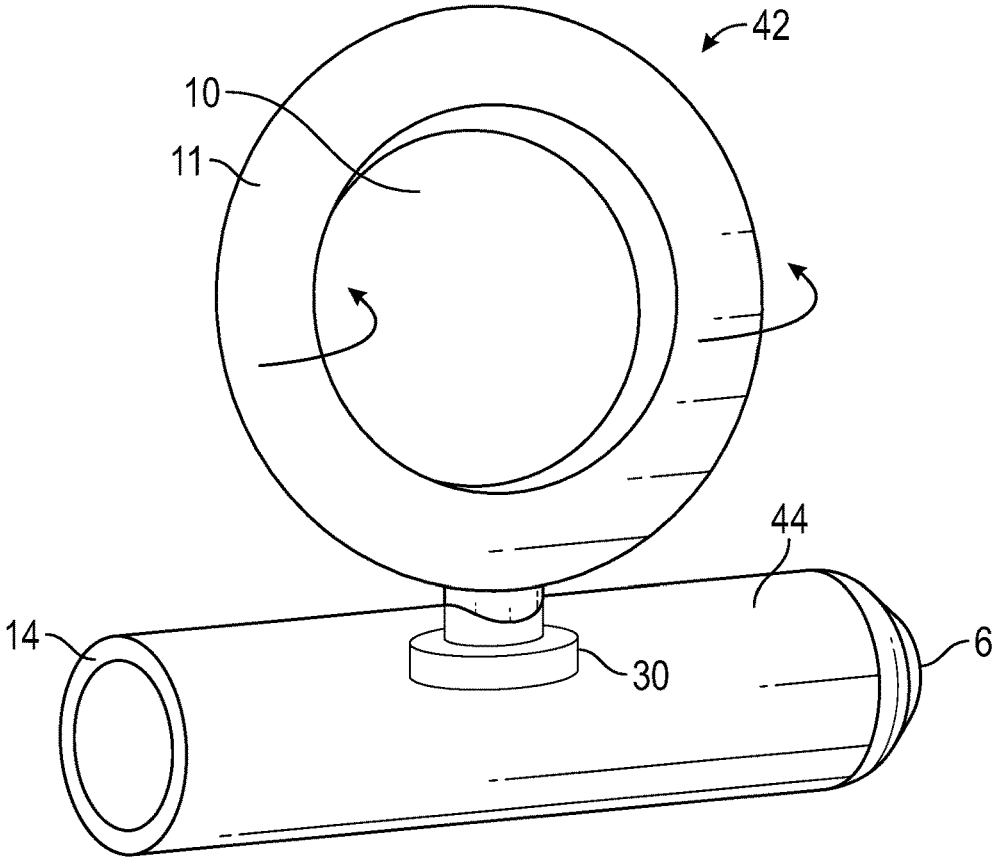
FIG. 6A is a view of a wearable safety device with a rotatable ring.
Figure 6B:
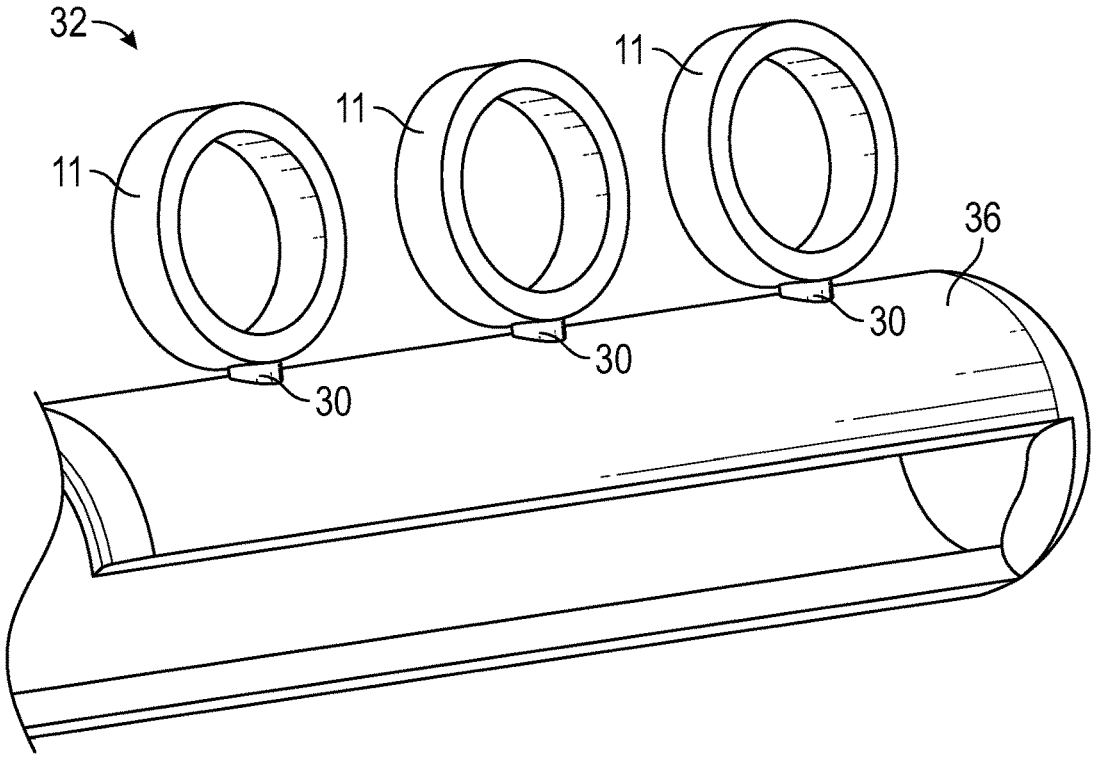
FIG. 6B is a view of wearable safety device with three rotatable rings.

A wearable safety device may have a single ring and the ring may be movable. A movable ring may increase the comfort and fit of the rings to a person's finger/hand. FIG. 6A shows a wearable safety device 42 with a rotatable ring 11. The ring 11 is attached to the wearable device 42 by a mount 30. The mount 30 is configured to rotate and rotate the ring 11 as shown by the arrows. The ring 11 may rotate and be locked into place. In some examples, the mount 30 and ring 11 may rotate up to 45°, up to 30°, up to 15°, or up to 5° and may rotate in either direction (e.g., clockwise or counterclockwise) from a base position (e.g., with the rings parallel to a longitudinal axis of a wearable safety device, such as shown in FIGS. 1-5). A wearable safety device may have multiple rings and the rings may rotate together or separately. FIG. 6B shows a wearable safety device 32 with three separate, rotatable rings 11. The rings 11 are mounted on the housing 36 with mounts 30. The mounts 30 and rings 36 may rotate individually or rotate together. In some variations, a plurality of rings may be connected together (e.g., along an edge or a dorsal side) and have a single mount, and rotating a single mount may rotate the plurality of rings. One step of using a wearable safety device may include rotating one or at least one, two or at least two, three or at least three, or four mount(s) and/or ring(s). Some variations may include the step of locking the one or more mount(s) and/or ring(s) in place, either before or after the rotating step.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

In general, any of the apparatuses and methods described herein should be understood to be inclusive, but all or a sub-set of the components and/or steps may alternatively be exclusive, and may be expressed as "consisting of" or alternatively "consisting essentially of" the various components, steps, sub-components or sub-steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A wearable safety device comprising:

an elongate housing with a first end and a second end and a length between, wherein the housing is generally cylindrically shaped and grippable by a user's hand;

a plurality of finger holders on an outside surface of the elongate housing, the finger holders each having an opening perpendicular to and extending away from a plane through the longitudinal axis of the housing, the finger holders configured to receive a user's fingers;

a light source in the elongate housing, the light source configured to direct a dazzling light in a direction generally opposite to the plurality of finger holders;

a camera in the elongate housing, the camera pointing in a direction generally opposite to the plurality of finger holder and in generally the same direction as the light source; and an on/off controller on the first end, the on/off controller configured to activate with a single user action both the light source and the camera to shine a dazzling light and capture an image at about the same time.

2. The wearable device of claim 1 further comprising a camera hole in the elongate housing, wherein the camera hole is on the opposite side of the housing from the plurality of finger holders.

3. The wearable device of claim 2 wherein the camera is configured to take an image through the camera hole.

4. The wearable device of claim 1 wherein the light source and a light covering extend along a long side of the housing between the first end and the second end.

5. The wearable device of claim 1 wherein the light source extends at least halfway along a long side of the housing between the first end and the second end.

6. The wearable device of claim 1 wherein the light source comprises a plurality of LED lights.

7. The wearable device of claim 1 wherein the light source comprises an elongate bank of co-linear LED lights.

8. The wearable device of claim 7 wherein the camera is co-linear with the LED lights.

9. The wearable device of claim 1 wherein the device is configured to deliver at least 100 lumens of light.

10. The wearable device of claim 1 wherein the device is less than about 6 inches in the longest direction and less than about 3 inches in a cross-sectional diameter.

11. The wearable device of claim 1 comprising three finger holders.

12. The wearable device of claim 1 wherein the finger holders are substantially coplanar.

13. The wearable device of claim 1 wherein the on/off controller is configured to be controlled by a user's thumb when the wearable device is in place on a user's hand.

14. A method of using a wearable safety device comprising:

placing a plurality of a user's fingers into openings of finger holders of a wearable safety device, wherein the wearable device comprises an elongate housing, a camera, and a dazzling light source, wherein the finger holders are connected to a long side of the elongate housing;

activating the camera and the dazzling light source;

directing the dazzling light and camera in a direction generally opposite to the plurality of finger holders; and taking a picture with the camera in the same direction that the light source dazzles.

15. The method of claim 14 wherein the light source comprises a plurality of LED lights co-linear with the camera.

16. The method of claim 14 further comprising resting an inside of the finger holders of the handheld device on the distal palmar surface of the hand.

17. The method of claim 14 further comprising raising the handheld device in front of the user's body and suspending the device from the user's hand.

18. The method of claim 14 wherein the step of activating the camera and the dazzling light source comprises delivering at least 300 lumens of dazzling light.

19. The method of claim 14 wherein the wearable safety device comprises an elongate housing with a first end and a second end and a length between, wherein the housing is generally cylindrically shaped and grippable by a user's hand and further comprises an on/off controller on the first end, the on/off controller configured to activate with a single user action both the light source and the camera to shine a dazzling light and capture an image at about the same time.

20. The method of claim 14 wherein the wearable safety device is configured to deliver optical radiation sufficiently bright to cause optical incapacitation, nausea, dizziness, headache, flash blindness, and/or vomiting when viewed by a person.

* * * * *